US007931348B2

(12) United States Patent
Kida

(10) Patent No.: US 7,931,348 B2
(45) Date of Patent: Apr. 26, 2011

(54) INKJET PRINTING APPARATUS

(75) Inventor: Akira Kida, Yokohama (JP)

(73) Assignee: Canon Kabushiki Kaisha., Tokyo (JP)

( * ) Notice: Subject to any disclaimer, the term of this patent is extended or adjusted under 35 U.S.C. 154(b) by 321 days.

(21) Appl. No.: 12/196,760

(22) Filed: Aug. 22, 2008

(65) Prior Publication Data

US 2009/0058895 A1 Mar. 5, 2009

(30) Foreign Application Priority Data

Aug. 27, 2007 (JP) ..... 2007-219943

(51) Int. Cl.
*B41J 29/393* (2006.01)
*B41J 23/00* (2006.01)
*B41J 2/01* (2006.01)

(52) U.S. Cl. ..... 347/19; 347/5; 347/8; 347/16; 347/20; 347/37; 347/39; 347/101; 347/104; 347/107

(58) Field of Classification Search ..... 347/8, 16, 347/19, 37, 39, 104, 107
See application file for complete search history.

(56) References Cited

U.S. PATENT DOCUMENTS

| | | | | |
|---|---|---|---|---|
| 6,092,939 | A * | 7/2000 | Nishikori et al. | 400/61 |
| 2004/0150703 | A1 * | 8/2004 | Nojima et al. | 347/104 |
| 2007/0024663 | A1 * | 2/2007 | Yamanobe | 347/19 |
| 2007/0047157 | A1 * | 3/2007 | Miyahara et al. | 360/324.11 |
| 2008/0007587 | A1 * | 1/2008 | Watanabe | 347/19 |

FOREIGN PATENT DOCUMENTS

JP 10-329381 12/1998

* cited by examiner

*Primary Examiner* — Ryan Lepisto
(74) *Attorney, Agent, or Firm* — Fitzpatrick, Cella, Harper & Scinto

(57) ABSTRACT

In an inkjet printing apparatus, uneven density is reduced while suppressing a landing position deviation caused by a difference of head-to-medium distances in a printing medium conveying direction. Specifically, predetermined patterns for detecting a difference of the head-to-medium distances are printed. Reading of the patterns is performed and then a detection of a difference between the head-to-medium distances is performed based on the reading result. Then, adjustment of the head-to-medium distance is performed based on the difference between the head-to-medium distances detected. Specifically, the respective head-to-medium distances at the upstream side ejection port and the downstream side ejection port are made equal by changing an attitude of the print head.

7 Claims, 14 Drawing Sheets

INKJET PRINTING APPARATUS

BACKGROUND OF THE INVENTION

1. Field of the Invention

The present invention relates to an inkjet printing apparatus, and specifically, relates to a configuration for adjusting a distance between a print head and a printing medium such as a printing sheet.

2. Description of the Related Art

In recent years, comparatively inexpensive office automation equipment, such as personal computers and word processors, are used generally; and accompanied with that, various printing apparatuses for printing information input by the office automation equipment, and technologies for increasing printing speed-up and technologies for achieving high printing quality have been developed rapidly. Among the printing apparatuses, a serial printer using dot matrix printing system receives attention as an apparatus for realizing high speed and high printing quality with low cost. In addition, as a technology for performing printing with high quality, for instance, a multi-pass printing system is known.

A high-speed printing can be realized by increasing the number of ink ejection ports in a print head provided with a plurality of the ink ejection ports, and by increasing a scanning speed of the print head. However, a bidirectional printing system is effective as a system for realizing the high-speed printing without such a constraint of the apparatus configuration. A one-directional printing is performed only by a scanning of one-direction movement from a predetermined scanning start position and is accompanied by non-printing movement in a reverse direction to return to the scanning start position from a scanning end position. Therefore, the bidirectional printing can perform the printing at the speed approximately twice as fast as that of the one-directional printing.

The multi-pass printing system as the technology for achieving high image quality can reduce uneven density depending on the variation in an ejection amount and/or an ejection direction of the ink caused by the variation of printing elements such as a shape of the ejection port, an ejection heater performance in the print head. In an ideal print head, the ink is ejected with an approximately uniform ejection amount and in the same alignment direction from the respective ejection ports. Then, when such ejection is performed, the ink dots uniform in size are formed with uniform arrangement on the printing medium, and thus obtaining the uniform image without uneven density as a whole. However, variation in manufacturing the print head or the like causes variation in ejection amount or the like. As a result, there exists a periodical blank part of a printing medium in the dot formation, or inversely, there occurs uneven density where the dots are formed in an overlapping state beyond necessity. In response to this, the multi-pass system carries out plural number of scans to the same printing area, and carries out printing by using different ejection ports in the respective scan. With this configuration, the variation of ejection amount in each ejection port can affect the printing in a state that the variation is dispersed among the plural number of scans, and accordingly, uneven density can be made inconspicuous. In the multi-pass printing, for instance, in the case of two-pass printing where the printing is completed by two scans, the printing data for first and second scans are generated by using masks, and are complemented to each other.

As other example of a technology for achieving high image quality in the dot matrix printing system, there is known a dot alignment technology adjusting a landing position of the ejected ink. The dot alignment is an adjusting method for adjusting a position where the dot is formed on the printing medium by some kind of means. By this adjustment, it is possible to suppress the uneven density caused by deviation of a dot formation position.

For instance, in the method described in the Japanese Patent Laid-Open No. 10-329381, a plurality of patterns are printed by backward and forward scans of the print head, in such a manner that printing start (ejection) timing of the backward scan is shifted by a specific amount to the forward scan for each pattern. These patterns are ones in which an area factor by the dot formed by the printing (ratio occupied by the ink dot in the specific area) differs for every pattern. Then, average density of each of the plurality of patterns is optically read. By this operation, the printing start timing corresponding to the pattern with the highest average density read can be set as a print positioning condition.

However, in the landing position adjustment using the ejection timing described above, it is comparatively difficult to deal with the case where an amount of landing position deviation differs in a conveying direction of the printing medium.

For example, a distance between the print head and the printing medium (hereinafter, also referred to as head-to-medium distance) may be different between an upstream side and a downstream side of the conveying direction of the printing medium. For instance, in some cases, small variation in dimensional tolerance of individual parts such as a platen, a carriage shaft or a chassis rail is stacked and appears as a difference of the head-to-medium distance between the upstream side and the downstream side. In this case, an amount of landing position deviation of the ink ejected from the ejection port at the upstream side in the print head becomes different from that at the downstream side in the print head. As a result, the unevenness of density is caused to be generated by deviation of a dot formation position in the conveying direction.

FIGS. 1 and 2 are diagrams for explaining this problem. FIG. 1 shows a landing position deviation when performing the bidirectional printing with respect to two head-to-medium distances which are different from each other. Here, a print head 11 scans back and forth with a velocity of Vd, and the ink is ejected with a velocity of Vh. As shown in FIG. 1, when the head-to-medium distance is a distance corresponding to "printing medium position 1", a distance between inks landing in the forward scan and the backward scan of the bidirectional printing is Δxu1. In this case, when the head-to-medium distance changes to a distance corresponding to "printing medium position 2", the distance between the landing inks at the forward and backward scans changes to Δxl1. In the case where a difference between the printing medium position 1 and the printing medium position 2 is approximately 0.2 mm, the difference between the distance of Δxl1 and the distance of Δxu1 is approximately 20 μm.

As mentioned above, in the case where the distance between the print head and the printing medium is different between the upstream side and the downstream side in the printing medium conveying direction, when the forward and backward printing is performed, in each of the forward and backward scans, the distance between landing inks from the upstream side ejection ports is different from the distance between the landing inks from the downstream side ejection ports. As a result, the unevenness of density is caused to be generated by deviation of dots formed by the landing inks.

FIG. 2 is a diagram explaining that, when an ink (hereinafter, referred to as satellite) is ejected with different velocity accompanied with the main ink droplet, in addition to the main droplet of the ink at the time of ink ejection, the landing position deviation between the main ink droplet and the satellite differs depending on the printing medium position (the head-to-medium distance).

In FIG. 2, the print head 11 scans with velocity of Vc. Then, the main ink droplet is ejected with the velocity of Vh, and the satellite is ejected with the velocity of Vs. In this case, when the printing medium is in the printing medium position 1, the distance of the landing positions between the main droplet and the satellite is Δxu2. When the printing medium is in the printing medium position 2, the distance of the landing positions between the main droplet and the satellite is Δxl2. Then, the distance Δxu2 differs from the distance Δxl2. The main ink droplet is made smaller as a printing resolution becomes higher, and accordingly, a difference of diameter between the satellite and the main ink droplet becomes smaller. Thereby, the satellite is also increasingly apt to add influence to a printing density.

As mentioned above, when the distance between the print head and the printing medium is different between the upstream side and the downstream side in the printing medium conveying direction, the unevenness of density due to the landing position deviation is caused to occur also by the fact that the distance between the landing positions of the main droplet and the satellite of the ink each ejected is different between the upstream side and the downstream side.

In order to suppress occurrence of problems mentioned above, it is desirable that the distance between the print head and the printing medium in the printing medium conveying direction be set to be equal anywhere. For instance, in the case where the landing position deviation caused by a difference of the head-to-medium distance in the printing medium conveying direction is prevented from occurring by using the method for adjusting the ejection timing described above, the ejection timing needs to be different in accordance with the head-to-medium distance, for instance, between the upstream side and the downstream side of an ejection port arrangement. However, in this case, distances between the landing positions of the main droplet and the satellite can not be changed. In addition, as other method, there is known a method in which, at a predetermined position of the printing apparatus, a distance between a member instead of the printing medium and the print head is adjusted, and thereby such adjustment is substituted for the adjustment of the head-to-medium distance. However, such adjusting method does not necessarily reflect actual distance between the print head and the printing medium, and accordingly, in some cases, the unevenness of density caused by the landing position deviation can not be eliminated, as a result.

SUMMARY OF THE INVENTION

An object of the present invention is to provide an inkjet printing apparatus capable of reducing an unevenness of density by suppressing landing position deviation due to a difference in distance between the print head and the printing medium in the printing medium conveying direction.

In a first aspect of the present invention, there is provided an ink jet printing apparatus that uses a print head on which a plurality of ejection ports are arranged to cause the print head to scan a printing medium for ejecting ink to the printing medium during the scan of the print head, to perform printing, the apparatus comprising: a pattern printing unit for performing printing of respective predetermined patterns by means of an upstream side ejection port and a downstream side ejection port, which are different in positions in a conveying direction of the printing medium, among the plurality of ejection ports, a detecting unit for detecting densities of the respective predetermined patterns of the upstream side ejection port and the downstream side ejection port, which are printed by the pattern printing unit, and detecting a difference between a distance between the upstream side ejection port and the printing medium and a distance between the downstream side ejection port and the printing medium, based on the detected respective densities, and an adjusting unit for performing an operation for changing the distances between the respective upstream and downstream side ejection ports and the printing medium, based on the difference of the distances detected by the detecting unit.

According to the above configuration, a difference of the head-to-medium distances between the upstream side ejection port and the downstream side ejection port is detected by printing a pattern and reading the printed pattern; and based on the detected difference, the head-to-medium distance can be adjusted by using a mechanism for changing an attitude of the print head. With this adjustment, it is possible to suppress the landing position deviation caused by the difference of distance between the print head and the printing medium in the printing medium conveying direction and reduce the unevenness of density.

Further features of the present invention will become apparent from the following description of exemplary embodiments with reference to the attached drawings.

DESCRIPTION OF THE EMBODIMENTS

There will be described an embodiment of the present invention in detail while referring to drawings below.

Figure 3:
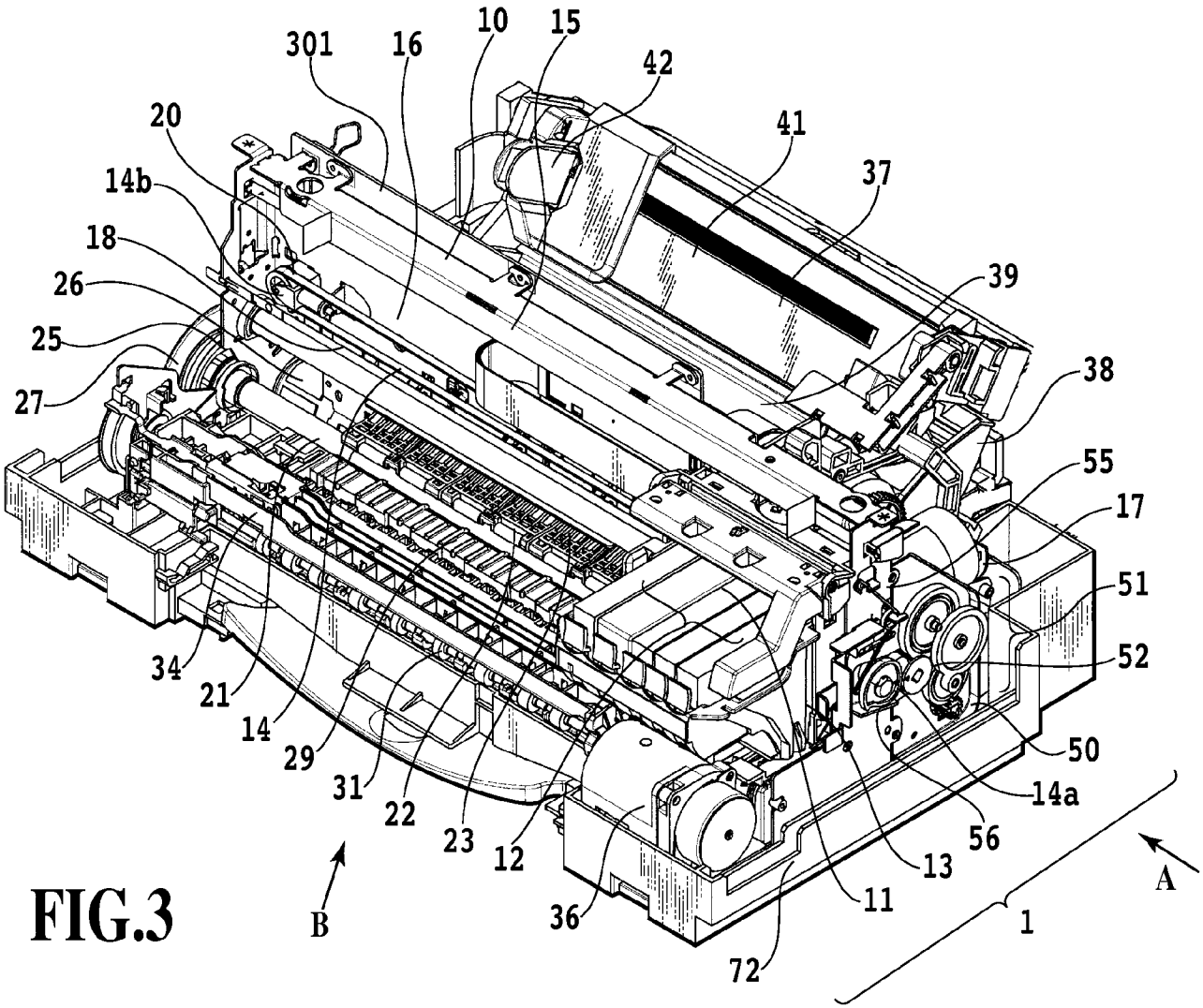
FIG. 3 is a perspective view showing the whole configuration of a printing apparatus to which the present invention is applied.
Figure 4:
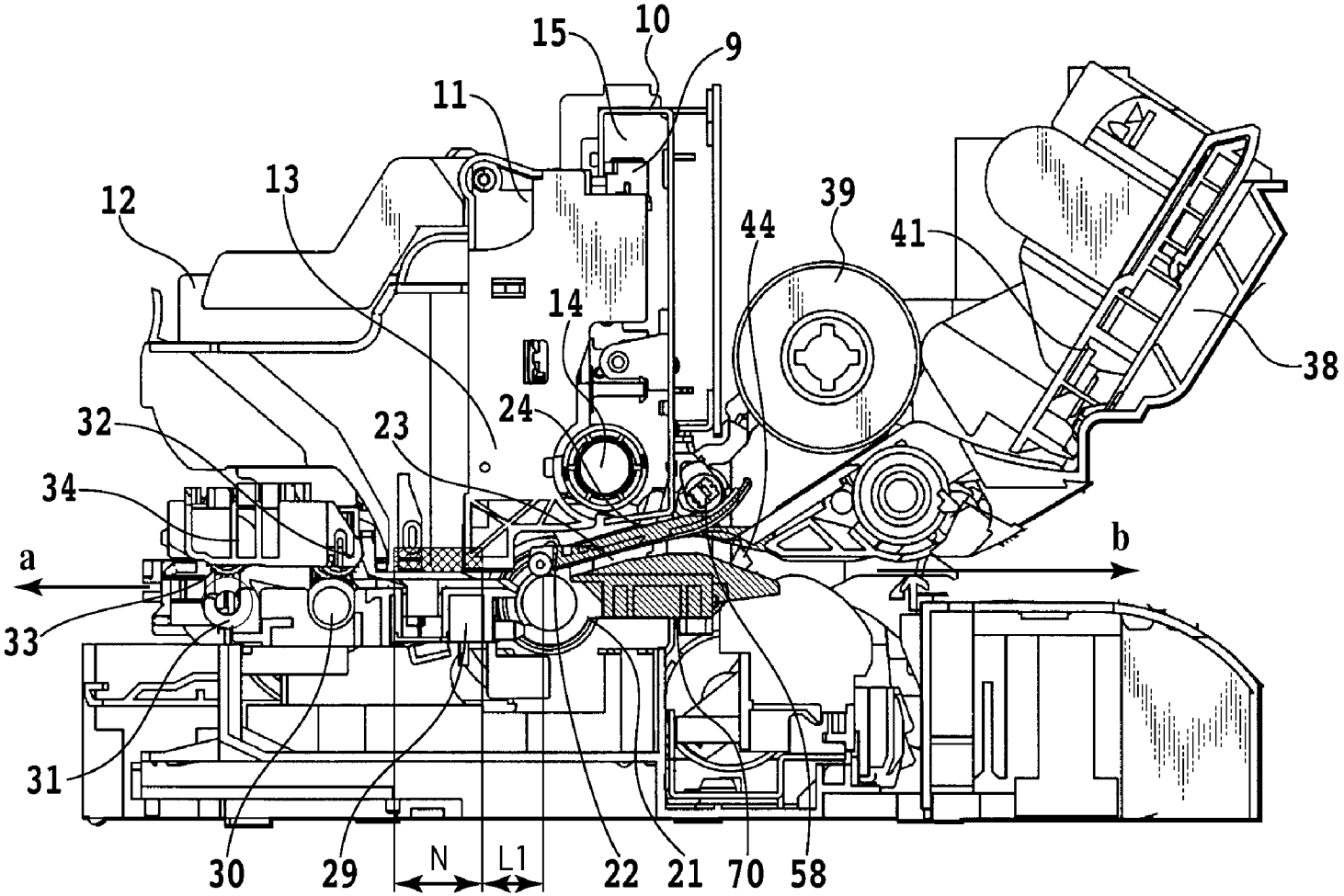
FIG. 4 is a cross sectional view of the whole configuration of the printing apparatus viewed from lateral direction, that is, viewed from an arrow A direction shown in FIG. 3.

FIG. 3 is a perspective view showing the whole configuration of a printing apparatus to which the present invention is applied. In addition, FIG. 4 is a cross sectional view of the whole configuration of the printing apparatus viewed from lateral direction, that is, viewed from an arrow A direction shown in FIG. 3. In these figures, reference numerals 1 and 10 denote a printing apparatus main body, and a chassis supporting a structure of the printing apparatus main body 1, respectively. In addition, reference numerals 11, 12 and 13 denote a print head performing the printing while ejecting an ink, an ink tank storing the ink supplied to the print head, and a carriage which holds to scan the print head 11 and the ink tank 12, respectively. Reference numerals 14 and 15 denote a guide shaft for supporting the carriage, and a guide rail for supporting the carriage in parallel to the guide shaft 14, respectively. In addition, reference numerals 16 and 17 denote a carriage belt for driving the carriage, and a carriage motor for driving the carriage belt 16 via a pulley, respectively. Further, reference numerals 18 and 20 denote a cord strip for detecting position of the carriage 13, and an idler pulley facing a pulley of the carriage motor 17 to stretch the carriage belt 16, respectively.

Reference numerals 21 and 22 denote a paper feeding roller conveying the printing medium such as the printing sheet, and a pinch roller which moves so as to follow the paper feeding roller 21 while being pressed thereby, respectively. In addition, reference numerals 23, 24 and 25 denote a pinch roller holder for holding the pinch roller 22 rotatably, a pinch roller spring for bringing the pinch roller 22 into pressure-contact with the paper feeding roller, and a paper feeding roller pulley fixed on the paper feeding roller, respectively. Further, reference numerals 26 and 27 denote an LF motor for driving the paper feeding roller, and a cord wheel for detecting a rotating angle of the paper feeding roller, respectively. A reference numeral 29 denotes a platen facing the print head 11 and supporting the printing medium. In addition, reference numerals 30 and 31 denote a first paper discharge roller for conveying the printing medium in cooperation with the paper feeding roller 21, and a second paper discharge roller provided at the downstream side of the first paper discharge roller 30, respectively. Further, reference numerals 32, 33 and 34 denote a first spur row facing the first paper discharge roller 30 and holding the printing medium, a second spur row facing the second paper discharge roller and holding the printing medium, and a spur base for holding the first spur row 32 and the second spur row 33 rotatably, respectively.

A reference numeral 36 denotes a maintenance unit which is used for preventing clogging of the ejection port of the print head 11 or at the time of replacing the ink tank 12. Reference numerals 37 and 38 denote a main ASF which loads the printing medium and supplies it one by one at the time of printing operation, and an ASF base as a base of the main ASF 37, respectively. In addition, reference numerals 39 and 40 respectively denote a paper feed roller abutting on the loaded printing medium to perform conveyance, and a separation roller for separating a plurality of printing media one by one when the plurality of printing media is conveyed simultaneously. Further, reference numerals 41 and 42 respectively denote a pressure plate for loading the printing media to energize them in the direction of the paper feed roller 39, and a side guide which is provided on the pressure plate 41 and capable of being fixed with arbitrary width of the printing media. Further, reference numerals 43 and 44 respectively denote a return claw for returning the leading edge of the printing medium which has overreached beyond a nip part between the paper feed roller 39 and the separation roller 40 during paper feeding operation back to the prescribed position, and an ASF flap for regulating a paper passing direction of the printing medium from the main ASF 37 in one direction. Further, reference numerals 50, 51 and 52 denote a lift input gear engaged with an ASF planetary gear 49, a lift reduction gear train transmitting a power from the lift input gear 50 while reducing the power, and a lift cam gear directly connected to a lift cam shaft, respectively.

Reference numerals 55, 56 and 58 denote a guide shaft spring for energizing the guide shaft putting it to one side, a guide slope on which a cam of a guide shaft gear 53 slides, and a lift cam shaft for lifting the pinch roller holder 23 or the like, respectively. In addition, reference numerals 70 and 72 denote a paper passing guide for guiding the leading edge of the printing medium to the nip part between the paper feeding roller 21 and the pinch roller 22, and a base for supporting the whole of the printing apparatus main body 1, respectively. Further, reference numeral 301 denotes a control substrate on which a control part is constituted.

Figure 5:
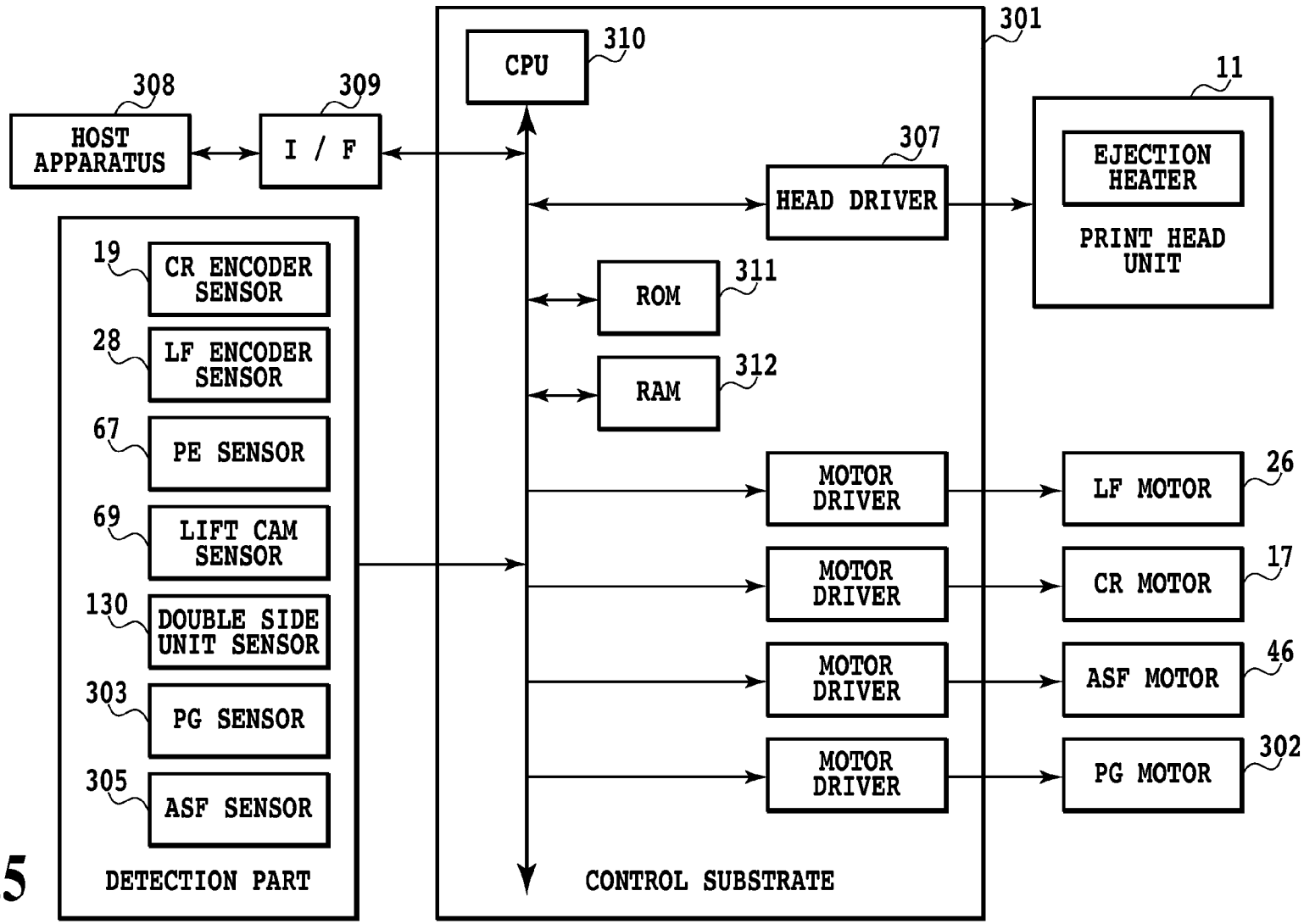
FIG. 5 is a block diagram showing a configuration of driving and its control in the printing apparatus of the present embodiment shown in FIGS. 3 and 4.

FIG. 5 is a block diagram showing a configuration for driving and control the driving in the printing apparatus of the present embodiment shown in FIGS. 3 and 4. In the same drawing, reference numerals 19 and 28 denote a CR encoder sensor which is mounted on the carriage 13, for reading the code strip 18, and an LF encoder sensor which is mounted on the chassis 1, for reading the code wheel 27, respectively. In addition, reference numeral 46 denotes an ASF motor for driving the main ASF 37. Further, reference numerals 67, 69 and 130 denote a PE sensor for detecting operation of a PE sensor lever, a lift cam sensor for detecting operation of the lift cam shaft 58, and a double side unit sensor for detecting the attachment/detachment of an automatic double side unit 2, respectively. Furthermore, reference numeral 302 denotes a PG motor for driving the maintenance unit 36. Moreover, reference numerals 303 and 305 denote a PG sensor for detecting operation of the maintenance unit 36, and an ASF sensor for detecting operation of the main ASF 37, respectively. Furthermore, reference numerals 307, 308 and 309 denote a head driver for driving the print head 11, a host apparatus for sending the printing data to the present printing apparatus, and an I/F for assisting to electrically connect the host apparatus with the present printing apparatus, respectively.

Reference numerals 310, 311 and 312 denote a CPU which governs control of the present printing apparatus to issue a control command, a ROM in which control data is written, and a RAM to be a region for developing the printing data or the like, respectively. The CPU 310 executes processing procedure later described in FIG. 7, in accordance with a program stored in the ROM 311 or the like.

The operation or the like of the printing apparatus of the present embodiment having the configuration mentioned above will be described.

Figure 1:
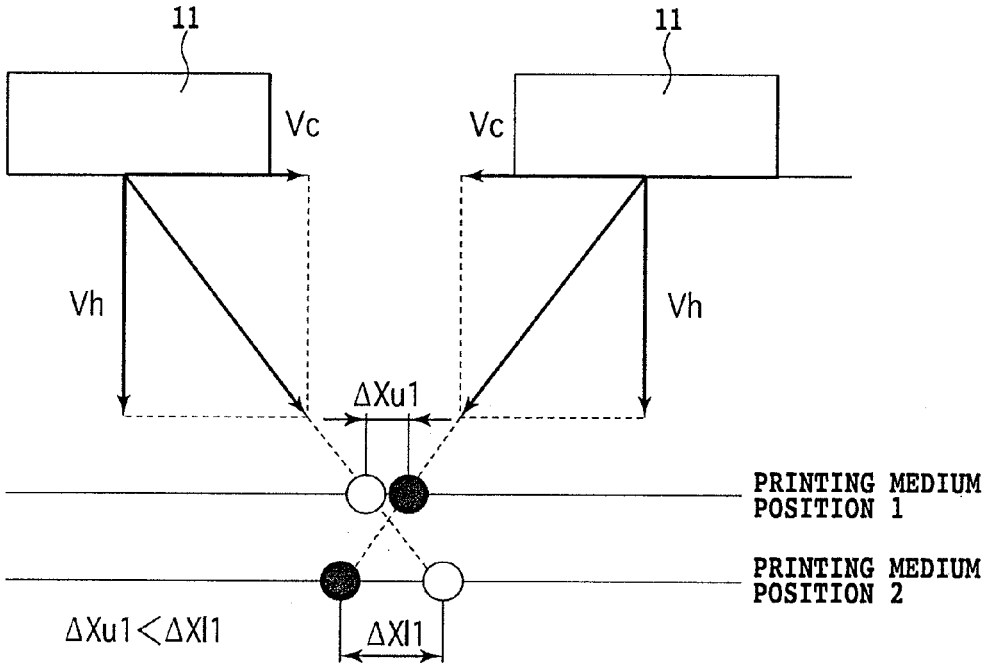
FIG.1 PRIOR ART
FIG. 1 is a diagram explaining deviation of a landing position when a bidirectional printing is performed with respect to two kinds of head-to-medium distances in the case of different head-to-medium distances.
Figure 2:
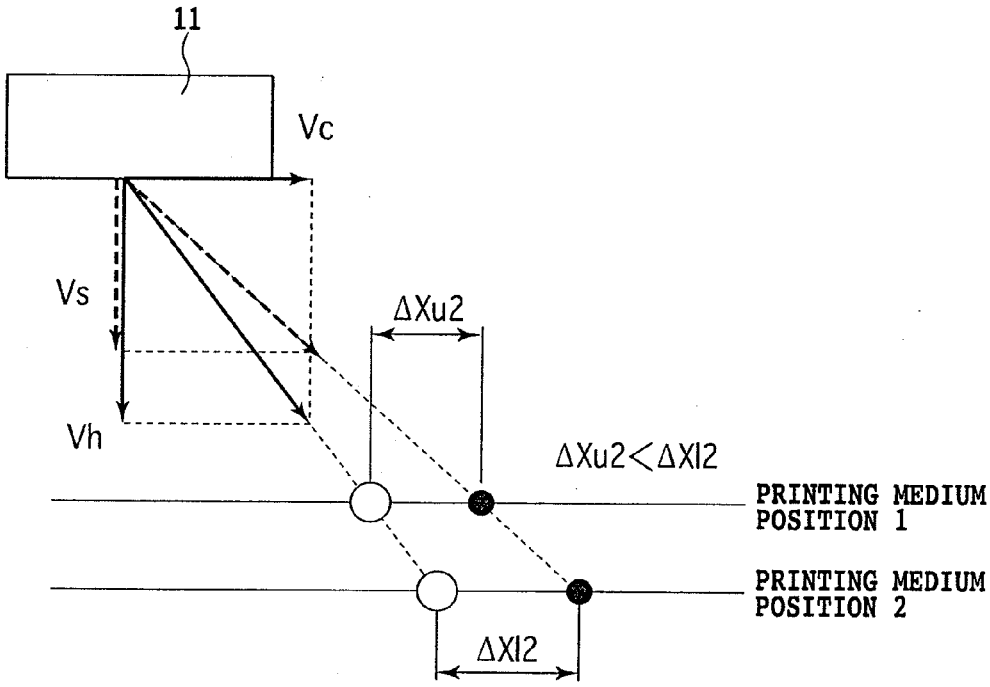
FIG.2 PRIOR ART
FIG. 2 is a diagram explaining that the landing position deviation between a main droplet of an ink and a satellite differs in accordance with the head-to-medium distance.

First, referring to FIGS. 1 and 2, the printing apparatus of the present embodiment is roughly composed of a paper feed part, a sheet conveying part, a printing part, and a print head maintenance part. When the printing data is transmitted from the host apparatus 308, and stored in the RAM 312 via the I/F 309, the CPU 310 issues a printing operation start command to start the printing operation. When the printing operation starts, first, paper feed operation is performed. The paper feed part is constituted by comprising the main ASF 37, draws out the printing medium one by one from the plurality of printing media (not shown) loaded on the pressure plate 41 in every printing operation and sends it to the sheet conveying part. At the start of the paper feed operation, the ASF motor 46 is rotated in the positive direction, and its power rotates the cam holding the pressure plate 41 through a gear train. When the cam is detached by the rotation, the pressure plate 41 is energized in the direction of the paper feed roller 39 by an action of the pressure plate spring not shown. At the same time, since the paper feed roller 39 rotates in the sheet conveying direction, conveyance of the printing medium at the top of the loaded printing media is started. On that occasion, in accordance with condition of a friction force between the paper feed roller 39 and the printing medium and the friction force between printing media, in some cases, a plurality of printing media is conveyed simultaneously. In that case, the separation roller 40 which is brought into pressure contact with the paper feed roller 39 and has predetermined return rotational torque in the opposite direction to the printing medium conveying direction operates to push back the printing media other than the printing medium existing on the most closest side of the paper feed roller 39 onto the original pressure plate. In addition, at the completion of ASF paper feed operation, the cam operation releases the pressure contact state between the separation roller 40 and the paper feed roller 39, so that the separation roller 40 is separated from the paper feed roller 39 by predetermined distance. On that occasion, in order to assuredly push back the printing media to the predetermined position on the pressure plate, the return claw 43 rotates to act as that role. Based on the above operation, only one sheet of printing medium is conveyed to the sheet conveying part. Meanwhile, when one sheet of the printing medium is conveyed from the main ASF 37, although the leading edge of the printing medium abuts on the ASF flap 44 energized with the ASF flap spring in a direction so as to interfere with a sheet passage path, the printing medium pushes aside the ASF flap 44 and passes. When the printing operation ends, and the rear edge of the printing medium passes through the ASF flap 44, the ASF flap 44 returns to original energized state, and the sheet passage path is closed. Thereby, even if the printing medium is conveyed in the opposite direction, the printing medium does not return to the main ASF 37 side.

The printing medium conveyed from the paper feed part is conveyed toward a nip part between the paper feeding roller 21 and the pinch roller 22 which make up the sheet conveying part. Since a center of the pinch roller 22 is mounted with a slight offset in a direction approaching the first paper discharge roller 30 with respect to a center of the pinch roller 22, an angle in the tangential direction into which the printing medium is inserted is slightly inclined to the level. Therefore, the sheet is conveyed at an angle on the sheet passage path formed by the pinch roller holder 23 and the sheet passing guide 70 so that the leading edge of the sheet is accurately guided to the nip part. The sheet conveyed by the ASF 37 abuts on the nip part of the paper feeding roller 21 in stop state. At this time, a loop of the sheet is formed at the area between the paper feed roller 39 and the paper feeding roller 21 upon conveying a slightly longer distance than length of predetermined sheet passage path by the main ASF 37. The leading edge of the sheet is pressed against the nip part of the paper feeding roller 21 by the force returning to straight condition of the loop, thereby the leading edge of the sheet follows the paper feeding roller 21 to become parallel, and thus so called operation for registration is completed.

After completing the operation for registration, the LF motor 26 is rotated in the direction where the printing medium moves in the positive direction (in the direction where the printing medium proceeds toward the first paper discharge roller 30). After that, the paper feed roller 39 with the driving force cut comes to co-rotate with the rotation of the printing medium. At this time point, the printing medium is conveyed only with the paper feeding roller 21 and the pinch roller 22. The sheet advances in the positive direction in every predetermined line feed amount, and proceeds along a rib provided at the platen 29. Although the leading edge of the sheet gradually reaches the first paper discharge roller 30 and the first spur row 32, and then the second paper discharge roller 31 and the second spur row 33, a circumferential velocity of the first paper discharge roller 30 and the second paper discharge roller 31 is set approximately equal to that of the paper feeding roller 21. In addition, since the first paper discharge roller 30, the second paper discharge roller 32 from the paper feeding roller 21 rotate synchronously with one another, because they are connected by the gear train. As a result, the sheet is conveyed without being loosened or pulled.

The printing part is constituted by mainly comprising the print head 11, and the carriage 13 moving in a direction orthogonal to the printing medium conveying direction while carrying the print head 11. The carriage 13 is supported by a guide shaft 14, and a guide rail 15 being part of the chassis 10. A slider 9 attached rotatably to the carriage 13 is arranged at a position between the carriage 13 and the guide rail 15 and slides with the guide rail. The carriage 13 scans back and forth when the driving force of the carriage motor 17 is transmitted to the carriage 13 via the carriage belt 16 stretched by the carriage motor 17 and the idler pulley 20.

The print head 11 has a plurality of ink supply paths connected to the ink tank 12, and the ink supply path is connected up to the ejection port array arranged on a surface of the print head facing to the platen 29. Actuators for ink ejection provided at respective ejection ports are arranged in the vicinity of the ejection port array. As the actuators for ink ejection, it is possible to use the one in which film boiling pressure of liquid by an electro-thermal converting element is utilized, an electro-pressure converting element such as a piezoelectric element, or the like.

The print head eject ink droplets according to printing data upon transmitting signals of a head driver 307 to the print head 11 via a flexible flat cable 73. In addition, it is possible to eject the ink drops toward the printing medium with appropriate timing, upon reading a code strip 18 stretched at the chassis 10 by a CR encoder sensor 19 carried on the carriage 13. Herewith, when one line of printing ends, the printing medium of a required amount is conveyed by the sheet conveying part. The printing operation over the entire surface of the printing medium becomes possible upon executing this operation repeatedly.

The print head maintenance part plays the role of preventing clogging of the ink ejection ports of the print head 11 or eliminating contamination by paper powder and the like, or the role for sucking ink when replacing the ink tank 12. For that reason, the maintenance unit 36 installed so as to face the print head 11 at the stand-by position of the carriage 13 is provided with a cap (not shown) for protecting the ink ejection port in contact with the ink ejection port surface of the print head 11. In addition, there are provided a wiper (not shown) for wiping the ink ejection port surface, and a pump (not shown) connected to a cap for generating negative pressure in the cap. When suctioning the ink in the ejection port of the print head 11, the ink is sucked by causing a negative pressure in the cap while driving the pump, by pressing the cap to the ejection port surface of the print head 11. In addition, in the case where the ink is adhered on the ejection port surface after sucking the ink, or in the case where foreign matter such as paper powder is adhered on the ejection port surface, in order to remove them, there is provided a mechanism for bringing a wiper into contact with the ejection port surface and for moving the wiper in parallel with the ejection ports surface.

The print head 11 has an ink ejection port region N positioned between the paper feeding roller 21 and the first paper discharge roller 30. Here, it is generally difficult to dispose the ink ejection port region N adjacent to the nip part of the paper feeding roller 21 caused by circumstances of an ink flow passage arrangement for the ejection port, or convenience of wiring for the actuator for causing the ink to be ejected. Therefore, in the region where the printing medium is sandwiched by the paper feeding roller 21 and the pinch roller 22, the printing can only be performed up to the range away by length L1 (FIG. 4) from the nip of the paper feeding roller to the downstream side. In order to reduce the margin area at the end of this printing medium, the printing apparatus of the present embodiment continues the printing operation up to a part where the printing medium gets out of the nip part of the paper feeding roller 21, and then is sandwiched by only the first paper discharge roller 30 and the second paper discharge roller 31 to be conveyed. With this arrangement, it becomes possible to perform the printing operation until the margin area at the end of the printing medium becomes zero.

Figure 6:
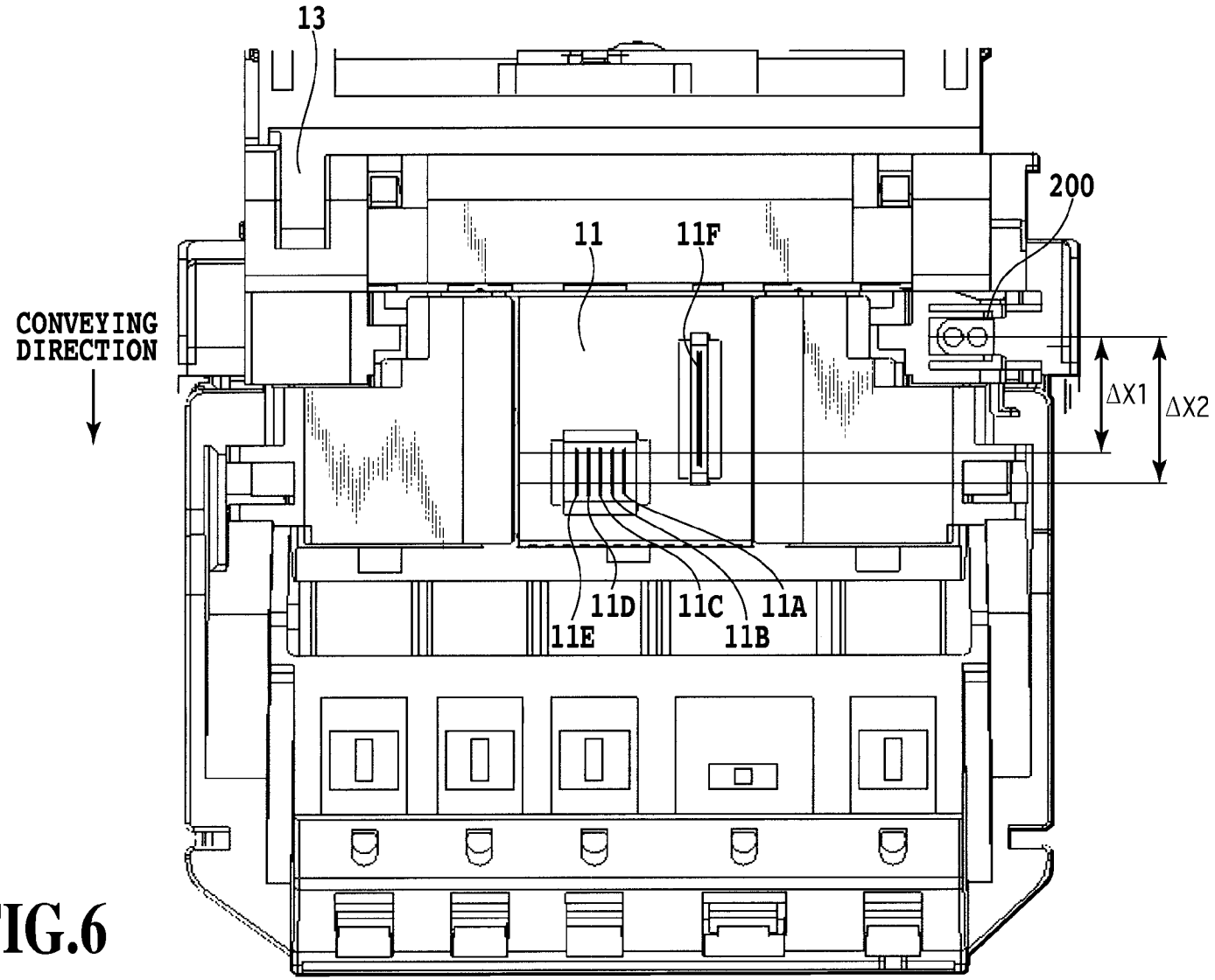
FIG. 6 is a view illustrating a positional relationship between a printing area by an ejection port array of the print head and an optical sensor according to an embodiment of the present invention.

FIG. 6 is a view illustrating a positional relationship between a printing area by ejection port arrays of the print head and an optical sensor according to an embodiment of the present invention, and the view in which the carriage part is viewed from an arrow B direction of FIG. 3.

In FIG. 6, in the normal printing operation, the printing is performed while conveying the printing medium in an arrow direction in the drawing. The print head 11 is provided with the respective ejection port arrays 11A, 11B, 11C, 11D and 11E, from which the inks of cyan (C), magenta (M), yellow (Y), light cyan (LC), and light magenta (LM) are ejected respectively. In addition, the ejection port array 11F ejecting the ink of black (K) is provided at a position shifted from these ejection port arrays in the conveying direction of the printing medium. The print head 11 is an inkjet print head ejecting the ink by using a thermal energy, and is provided with electro-thermal transducers for generating the thermal energy. That is, film boiling is generated by thermal energy generated by the electro-thermal transducers, and then the ink is ejected from the ejection port by utilizing a pressure of a bubble.

In addition, at the undersurface side of the carriage 13, a reflective optical sensor 200 is provided at a position of the upstream side in the conveying direction from the ejection port array group described above. The reflective optical sensor 200 is configured to detect the density of an image by causing a reflection of light at the region where the image is formed.

In a density reading of the printing pattern for measuring the head-to-medium distance described in FIG. 7 or later, the printing medium on which a pattern is printed is conveyed to a position where an optical axis of the reflective optical sensor 200 overlaps, and the pattern is scanned by the reflective optical sensor 200 while moving the carriage 13. By this scanning, the sensor 200 detects the density of the pattern based on the light reflected from the pattern. For this pattern reading, the printing medium on which the pattern is printed is conveyed in the opposite direction (hereinafter referred to as a back feed) to the normal conveying direction, corresponding to the amount of Δx1 or Δx2 in the drawing.

In the pattern formation for measurement of the head-to-medium distance, among the ejection port arrays described above, two ejection ports are used which are relatively positioned at the upstream side and the downstream side in the printing medium conveying direction. As shown in FIG. 6, one ejection port among the ejection port array 11F is taken as the upstream side ejection port existing in the distance of Δx1 from the reflective optical sensor 200. In addition, for instance, the ejection port of the ejection port array 11A is taken as the downstream side ejection port existing in the distance of Δx2.

First Embodiment

Figure 7:
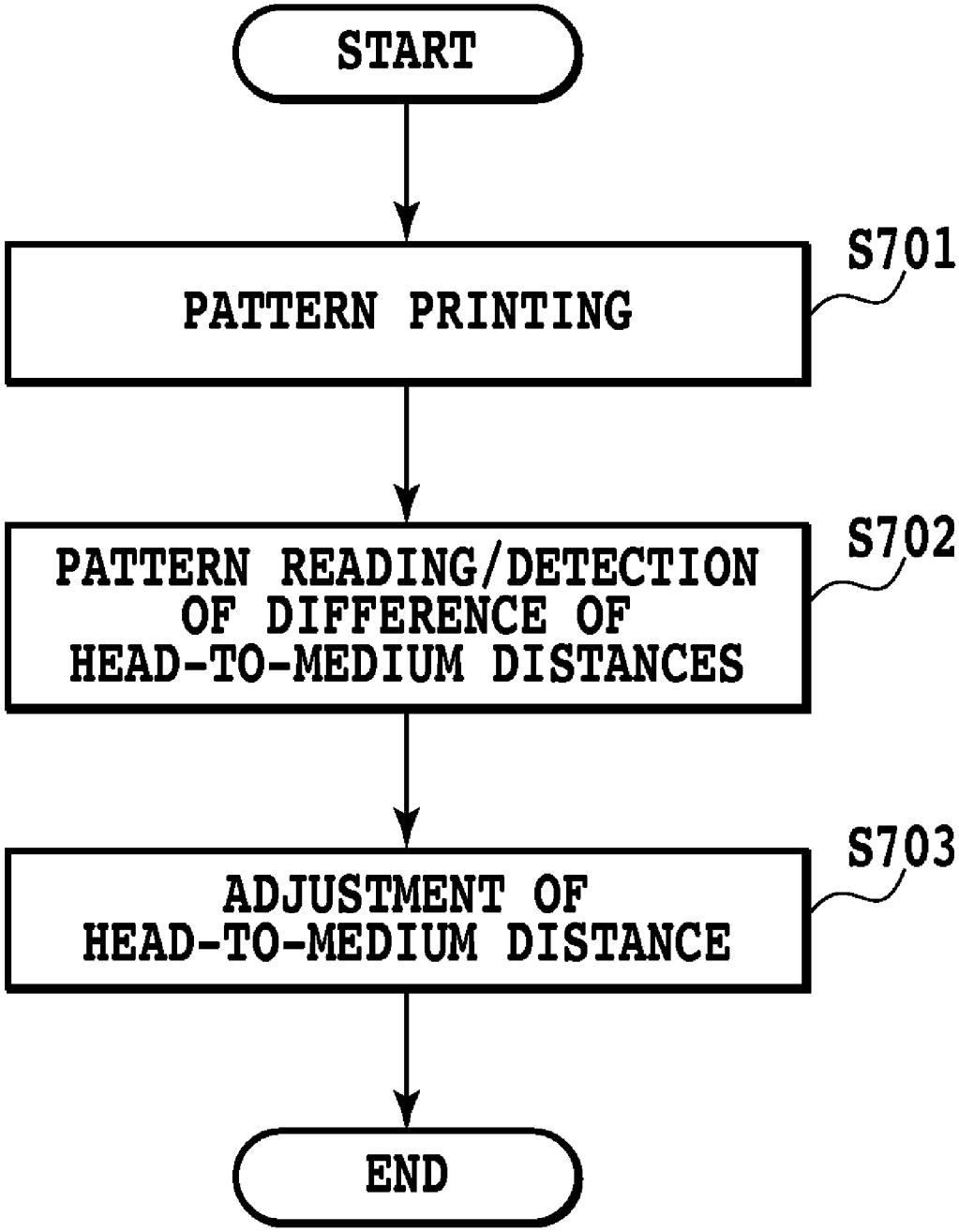
FIG. 7 is a flowchart showing measurement of the head-to-medium distance and processing of adjustment of the head-to-medium distance based on the measurement.

FIG. 7 is a flowchart showing measurement of the head-to-medium distance and processing of adjustment of the head-to-medium distance based on the measurement according to one embodiment of the present invention.

In FIG. 7, first, a predetermined pattern for detecting a difference of the head-to-medium distances is printed (S701). At this time, in a case where there is a difference between the sheet-to-medium distance at the position of the upstream side ejection port and that at the position of the downstream side ejection port, a difference occurs in distances between formed dots in mutual head-to-medium distances, as described before in FIGS. 1 and 2.

Figure 8:
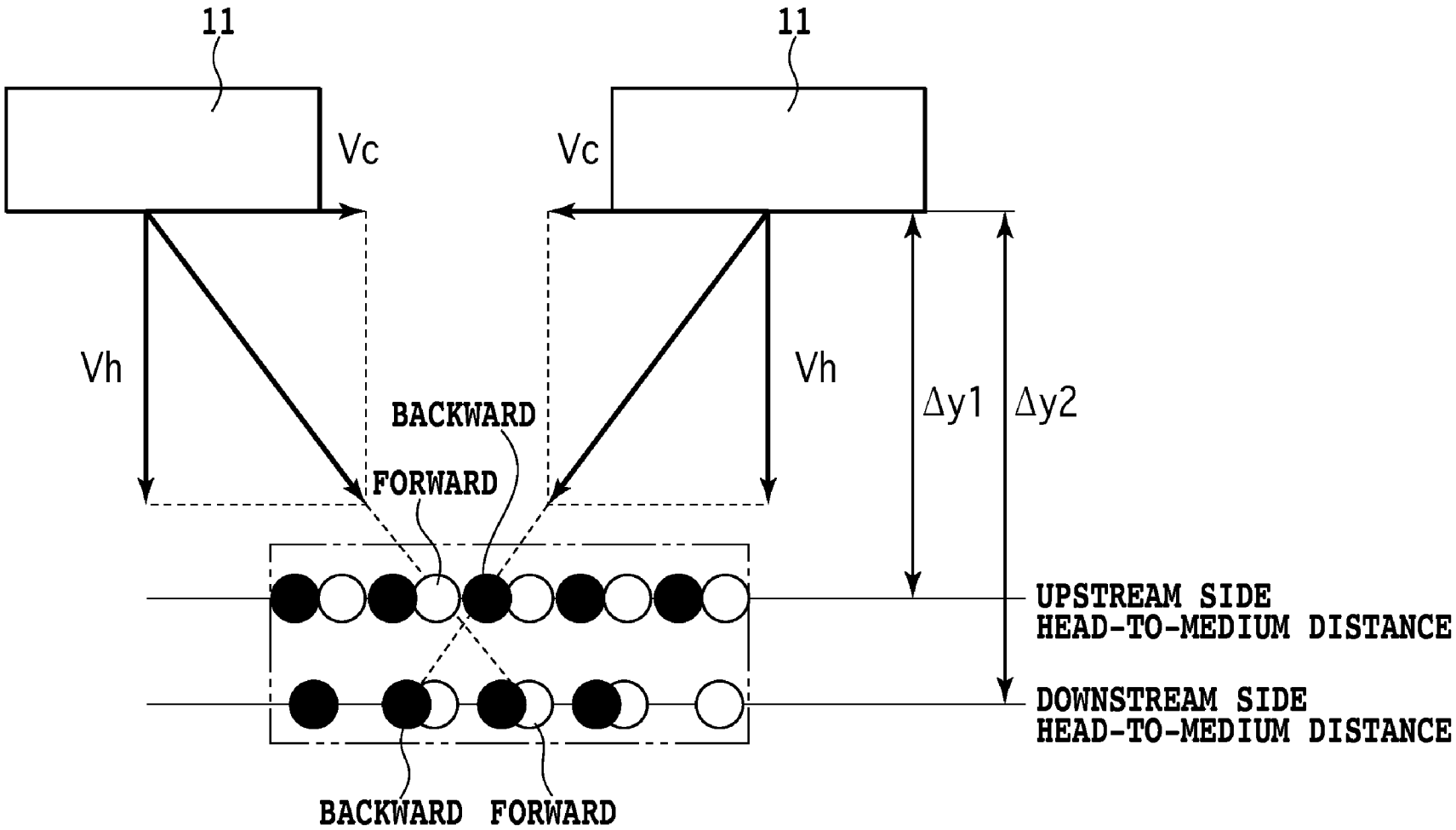
FIG. 8 is a diagram showing that a distance between dots of patterns printed by respective reciprocating printings is different between the upstream side and the downstream side.

FIG. 8 is a diagram illustrating that state, and shows that distances between dots printed by the respective reciprocating printings is different between the upstream side and the downstream side. As shown in FIG. 8, the head-to-medium distance between the downstream side ejection port and the printing medium is Δy1, and the head-to-medium distance between the upstream side ejection port and the printing medium is Δy2. When a difference occurs in the head-to-medium distances in this conveying direction, dots are formed with constant interval by the forward-direction scanning through the respective upstream side ejection port and downstream side ejection port in that direction. Then, dots are similarly formed by a backward-direction scanning with constant intervals at the position between dots formed by the above described forward-direction scanning. The pattern for adjusting the head-to-medium distance is formed by repeating the respective dots formation according to such reciprocating scanning by a specified number of times while performing line feed (conveyance of predetermined amount of the printing media).

Figure 9A:
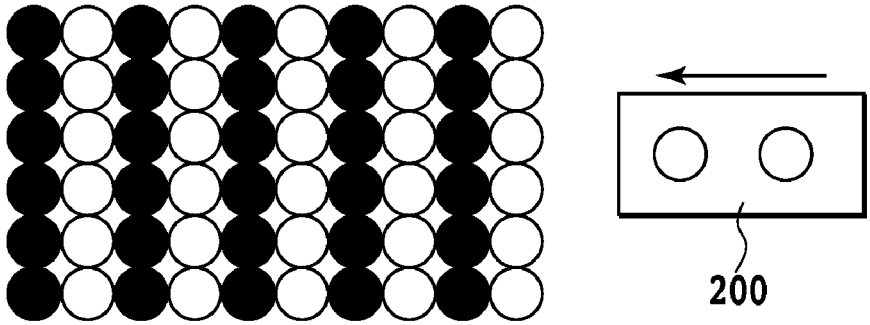
FIGS. 9A to 9C are diagrams showing patterns printed by the ejection ports at the upstream side and the downstream side, and detection results.
Figure 9B:
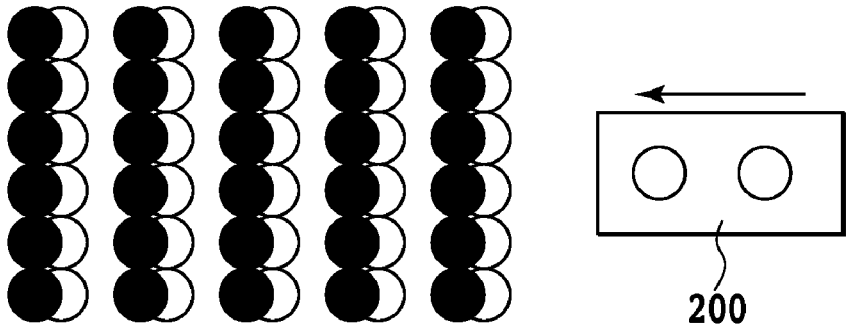

Left diagrams of FIG. 9A and FIG. 9B show the patterns printed by the ejection ports at the upstream side and the downstream side respectively. Specifically, FIG. 9A is a pattern printed with the head-to-medium distance Δy1 shown in FIG. 8, while FIG. 9B is a pattern similarly printed with the head-to-medium distance Δy2. The pattern of the head-to-medium distance Δy1 is such that the region of the printing medium is filled with the dots, while the pattern of the head-to-medium distance Δy2 is such that a pitch between the dots is not uniform, many overlapping of dots formed by the forward and backward scanning occurs, and ground of the printing medium can be seen.

Referring to FIG. 7 again, after the pattern printing as mentioned above, reading of the pattern and detection of a difference of the head-to-medium distances based on the reading is performed (S702).

Specifically, as described in FIG. 6, the respective patterns obtained by conveying the print medium in the opposite direction to that at the time of ordinary printing and by printed are positioned sequentially within the scanning region by the sensor 200. Then, the scanning of the pattern by the sensor 200 is performed while moving the carriage 13 to detect density of the pattern.

Figure 9C:
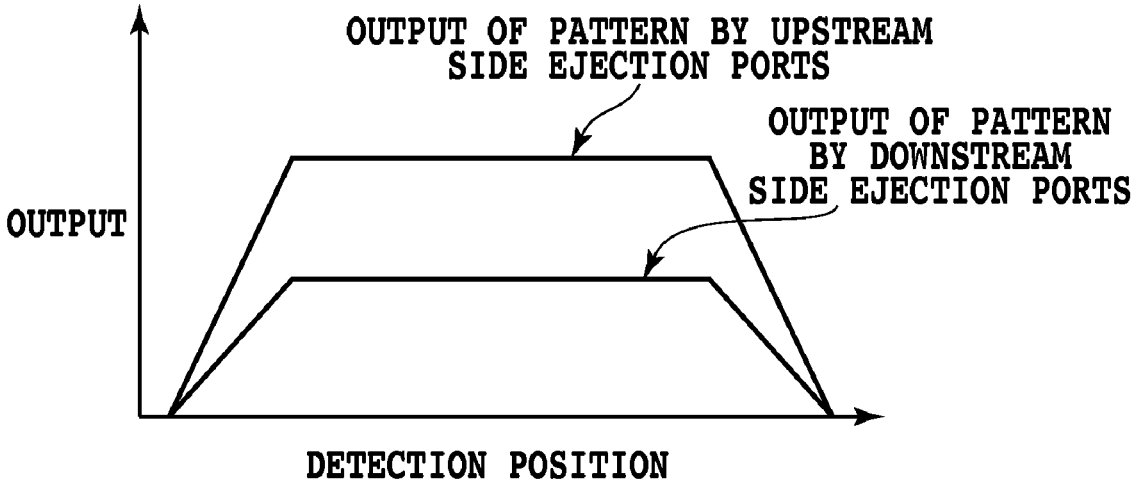

FIG. 9C is a diagram showing a detection value of the pattern by the sensor 200. Since the pattern printed by the upstream side ejection port with the head-to-medium distance Δy1 has high density, the detection value becomes high. On the other hand, since the pattern printed by the downstream side ejection port with the head-to-medium distance Δy2 has lower density, the detection value becomes lower value. The present embodiment detects a difference of the respective head-to-medium distances between the upstream side ejection port and the downstream side ejection port based on the difference of the detection values between the pattern by the upstream side ejection port and the pattern by the downstream side ejection port, with the sensor 200. Specifically, there is previously obtained correspondence between output difference of the sensor 200 and the difference of the head-to-medium distances as table information, and when detecting a difference of the head-to-medium distances, the table is referred with an output difference of the sensor to obtain the difference of the head-to-medium distances.

Referring to FIG. 7 again, after performing reading of the pattern and detection of a difference of the head-to-medium distances based on the reading as described above, next, adjustment of the head-to-medium distance is performed (S703). In the embodiment of the present invention, as described below, the respective head-to-medium distances at the upstream side ejection port and the downstream side ejection port are made equal by changing an attitude of the print head.

Figure 10:
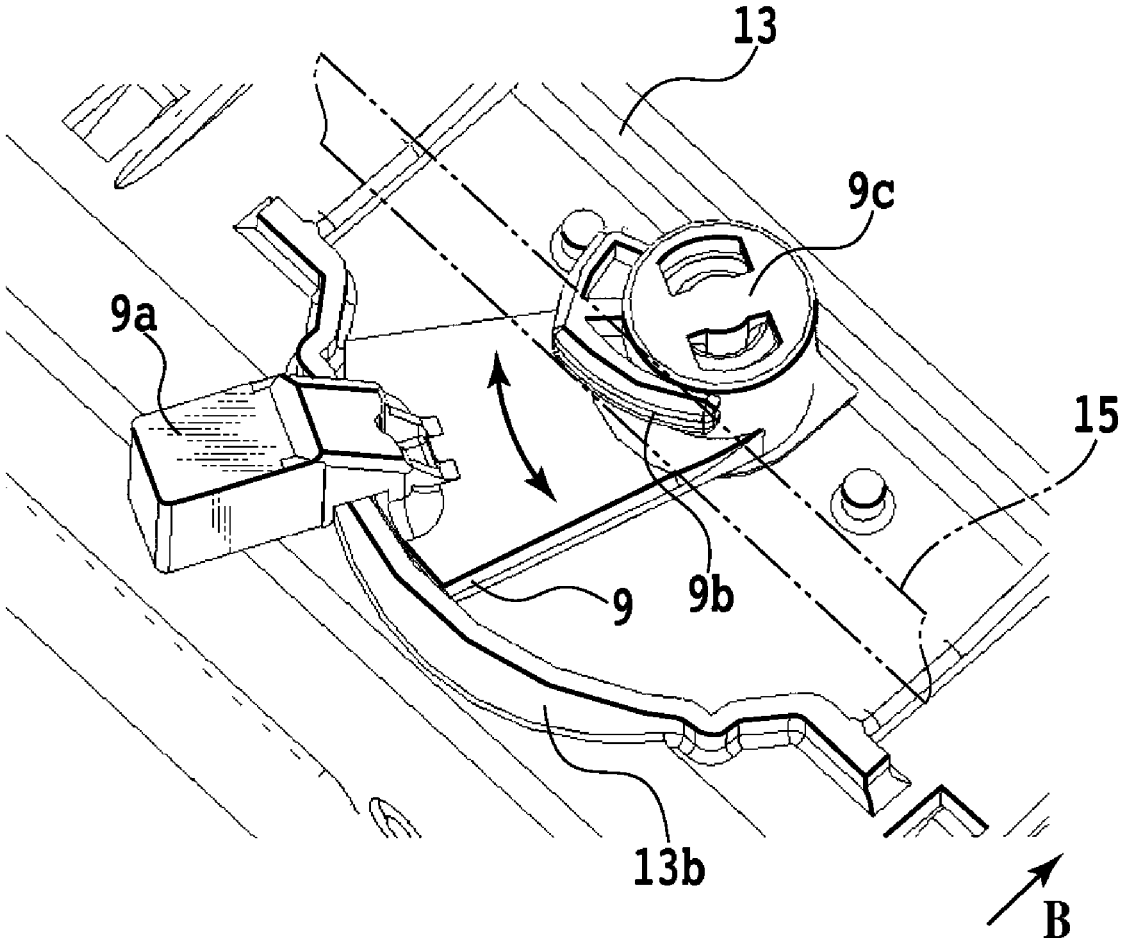
FIG. 10 is a view showing a slider provided so as to enable the turning on an upper surface of the carriage in the printing apparatus according to one embodiment of the present invention.

FIG. 10 is a view showing a slider provided so as to be able to turn on an upper surface of the carriage. The slider 9 is provided to be turnable about a rotation center 9*c* as an axis on the upper surface of the carriage 13.

In addition, the slider 9 is provided with a guide rail contacting part 9*a* contacting with contact parts 15*a*, 15*b* (FIG. 11) by the movement of the carriage, which contact parts are provided adjacent to respective end parts at the both sides of the guide rail 15. The contacting part 9*a* contact with a contact surface of the guide rail, and the slider 9 turns with the rotation center 9*c* as the axis upon further moving the carriage.

The slider 9 is further provided with a guide rail contacting part 9*b* contacts with a surface of the guide rail 15 along the surface of the same. The guide rail contacting part 9*b* has a shape that, when the slider 9 turns as described above, the contacting part with which the guide rail 15 contacts changes, and at the same time, distance to the contact position from the rotation center changes gradually. That is, the guide rail contacting part 9*b* has a shape with the cam action.

Figure 11A:
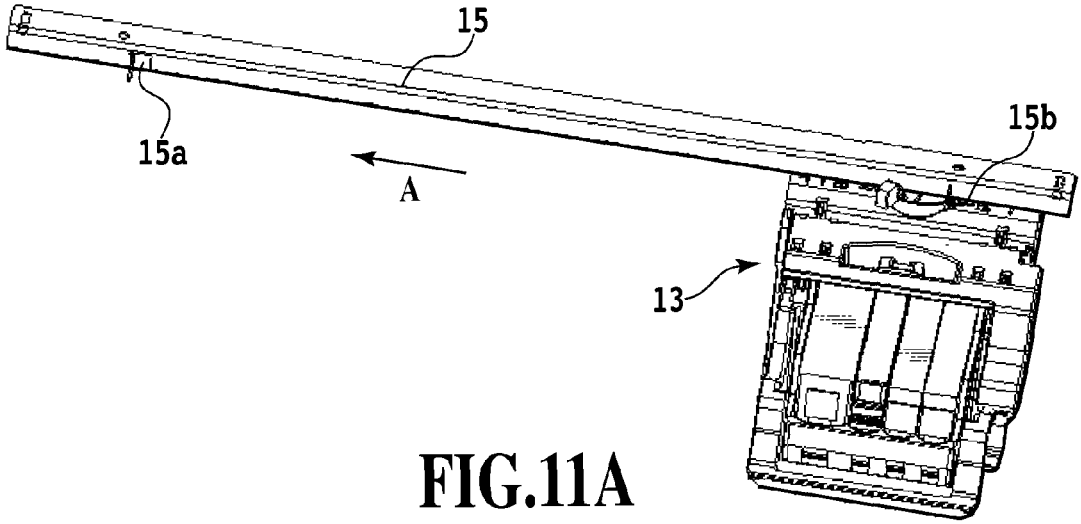
FIGS. 11A and 11B are views illustrating a configuration in which the slider 9 shown in FIG. 10 is turned by movement of the carriage.
Figure 11B:
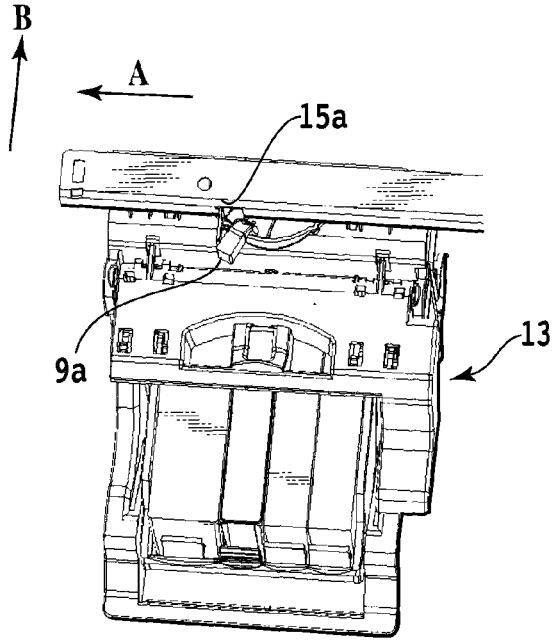

FIGS. 11A and 11B are views illustrating a mechanism in which the slider 9 is turned by the movement of the carriage. On the guide rail 15, as described above, there are provided the contacting parts 15*a*, 15*b* with which the contacting part 9*a* of the slider 9 contacts, in the vicinity of the respective both ends. The carriage 13 is moved in an arrow A direction to cause the contacting part 9*a* of the slider 9 to contact with the contact part 15*a* of the guide rail 15. FIG. 11B is a view showing the state where the contacting part 9*a* of the slider 9 contact with the contact part 15*a* of the guide rail 15. When further moving the carriage 13 in the arrow A direction from this state, the slider 9 turns with the rotation center 9*c* as the axis.

In the adjustment of the head-to-medium distance, a turning amount of the slider can be determined by controlling moving amount of the carriage at this contacting condition. More specifically, since movement of the carriage is controlled by encoder signals, it is possible to control turning amount of the slider 9 based on a moving position of the carriage.

Figure 12A:
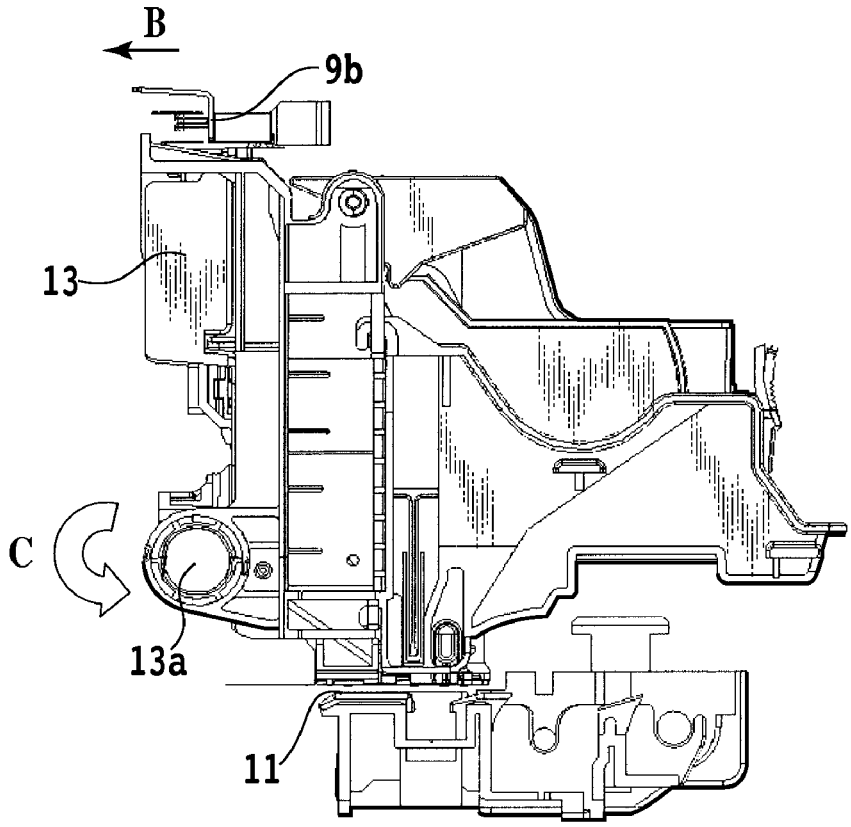
FIGS. 12A and 12B are diagrams explaining adjustment of the head-to-medium distance based on turning of the above described slider.
Figure 12B:
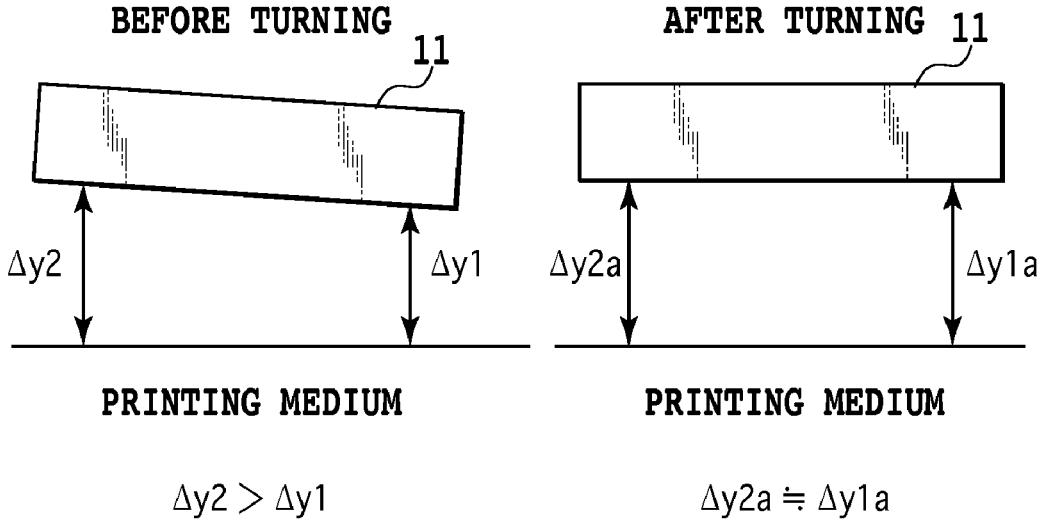

FIGS. 12A and 12B are views illustrating an adjustment of the head-to-medium distance by means of the above turning of the slider. As shown in FIG. 10 in detail, when the slider 9 turns, a contacting portion of the contacting part 9*b* of the slider contacting with the guide rail 15 changes. Then, the slider 9 (and the carriage 13 supporting the slider) moves in an arrow B direction, while, for instance, pressing the guide rail 15 according to the cam action of that change. As a result, as shown in FIG. 12A, the carriage 13 and the print head 11 supported by the carriage 13 turns in an arrow C direction in the drawing with a bearing part 13*a* of the carriage as center. Thereby, as shown in FIG. 12B, the print head 11 also turns, and the respective head-to-medium distances Δy2, Δy1 at the upstream side ejection port and the downstream side ejection port results in relationship of Δy2*a*≈Δy1*a* from relationship of Δy2>Δy1. That is, the respective head-to-medium distances at the upstream side ejection port and the downstream side ejection port become equal. In other wards, the distances are changed so that the detected density of the pattern becomes equal between the upstream side ejection port and the downstream side ejection port.

It should be noted that, as described above, though the contacting part 9*a* of the slider 9 turns according to the contacting with the contact part of the guide rail 15, the position after that turning is fixed. Thereby, the head-to-medium distance after the adjustment described above is maintained to allow an ordinary printing operation. The fixing of the turning position of the slider 9 in this case becomes possible in such a way that a groove of the contacting part 9*a* of the slider 9 is engaged with a fixing member 13*b* having elasticity provided on the upper surface of the carriage 13, as shown in FIG. 10. More specifically, the fixing member 13*b* elastically deforms accompanied with turning of the slider 9, and at the fixing position, an elastic force corresponding to that deformation is applied to the contacting part 9*a*; and thereby the contacting part 9*a* of the slider 9 is made not to move along the fixing member 13*b*.

In cases where a difference of the head-to-medium distances at the upstream side ejection port and the downstream side ejection port is desired to be adjusted in the opposite direction, the carriage is moved in the opposite direction to the moving direction (arrow A) of the carriage shown in FIG. 11A. Then, the guide rail contacting part 9*b* of the slider 9 is caused to contact with the right side contacting part 15*b* in the guide rail 15. Thereby, it is possible to change the head-to-medium distance upon turning the slider 9 in the opposite direction.

In the actual head-to-medium distance adjustment, the head-to-medium distances at the upstream side ejection port and the downstream side ejection port may substantially coincide with each other, by repeating a plurality of times of the pattern printing process, the pattern reading and a difference of the head-to-medium distance detecting process, and the head-to-medium distance adjusting process described in the above. For instance, when a difference of 0.2 mm of the head-to-medium distances between the upstream side ejection port and the downstream side ejection port is generated, the landing position deviation of about 10 μm is generated (in the case of bidirectional printing; 20 μm). Adjustment becomes possible by giving an amount of change on the order of approximately 0.6 mm as the amount of change of the slider contacting part of this case.

As described above, according to the present embodiment, by printing the pattern and reading that pattern, a difference of the head-to-medium distances at the upstream side ejection port and the downstream side ejection port is detected, and based on that difference, it is possible to adjust the head-to-medium distance by a mechanism which changes the attitude of the print head. Herewith, it becomes possible to suppress the landing position deviation caused by a difference of distances between the print head and the printing medium in the printing medium conveying direction, and to reduce the uneven density.

Other Embodiment

Figure 13:
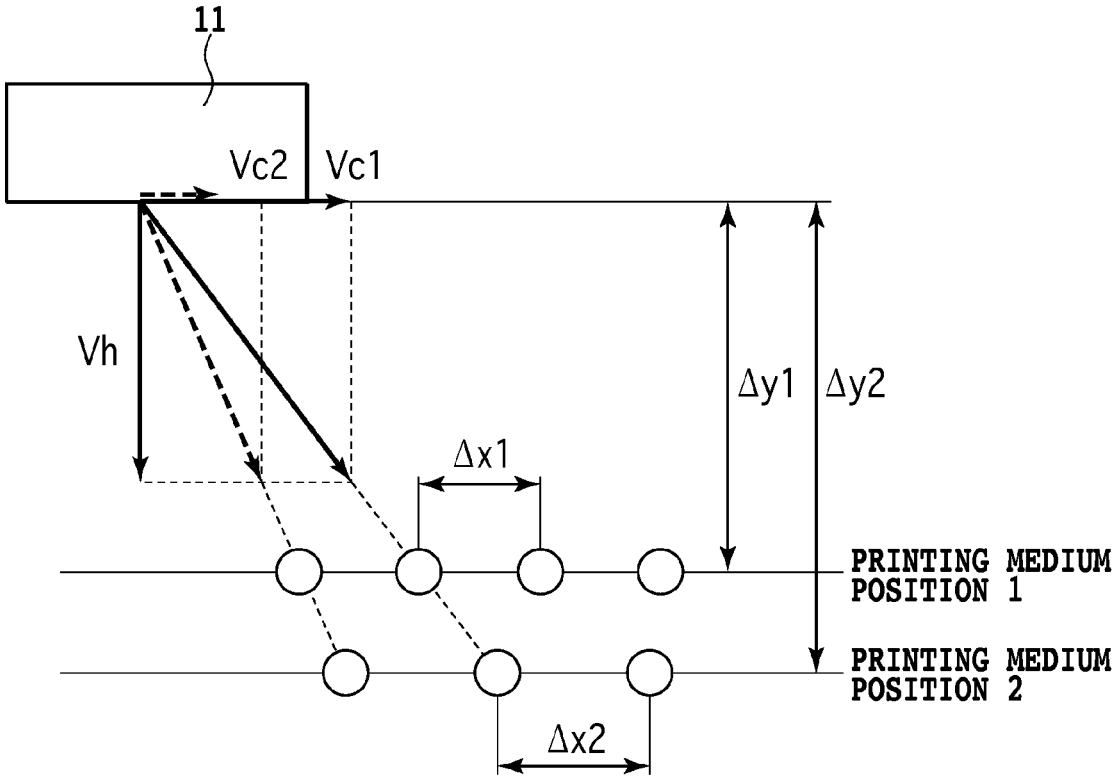
FIG. 13 is a diagram illustrating other configuration of the printing of head-to-medium distance adjustment pattern.

FIG. 13 is a diagram illustrating other embodiment of the printing of the head-to-medium distance adjustment pattern. In the pattern printing of the present embodiment, the print head 11 scans in two kinds of speed of Vc1 and Vc2; and the dots are formed with predetermined intervals according to the two kinds of speed of the scanning. The head-to-medium distance of the printing medium position 1 according to the upstream side ejection port is designated as Δy1, while the head-to-medium distance of the printing medium position 2 according to the downstream side ejection port is designated as Δy2.

In this case, when there is a difference between the head-to-medium distances Δy1 and Δy2, the respective intervals of dots printed in the speeds Vc1 and Vc2 are designated as Δx1 at the printing medium position 1 and Δx2 at the printing medium position 2, and the intervals of dots differ from each other to become Δx2>Δx1. As mentioned above, also in the pattern printing of the present embodiment, when there is a difference in the head-to-medium distances, a difference of the density between patterns is generated as shown in FIGS. 9A and 9B.

The above dot formation, like the first embodiment, forms the printing pattern by using only the upstream side ejection port, and then by using only the downstream side ejection port, while the printing medium is line-fed in the conveying direction. Then, similarly, it is possible to detect the deviation of the head-to-medium distance by detecting and comparing the density of the respective patterns with the sensor.

Figure 14:
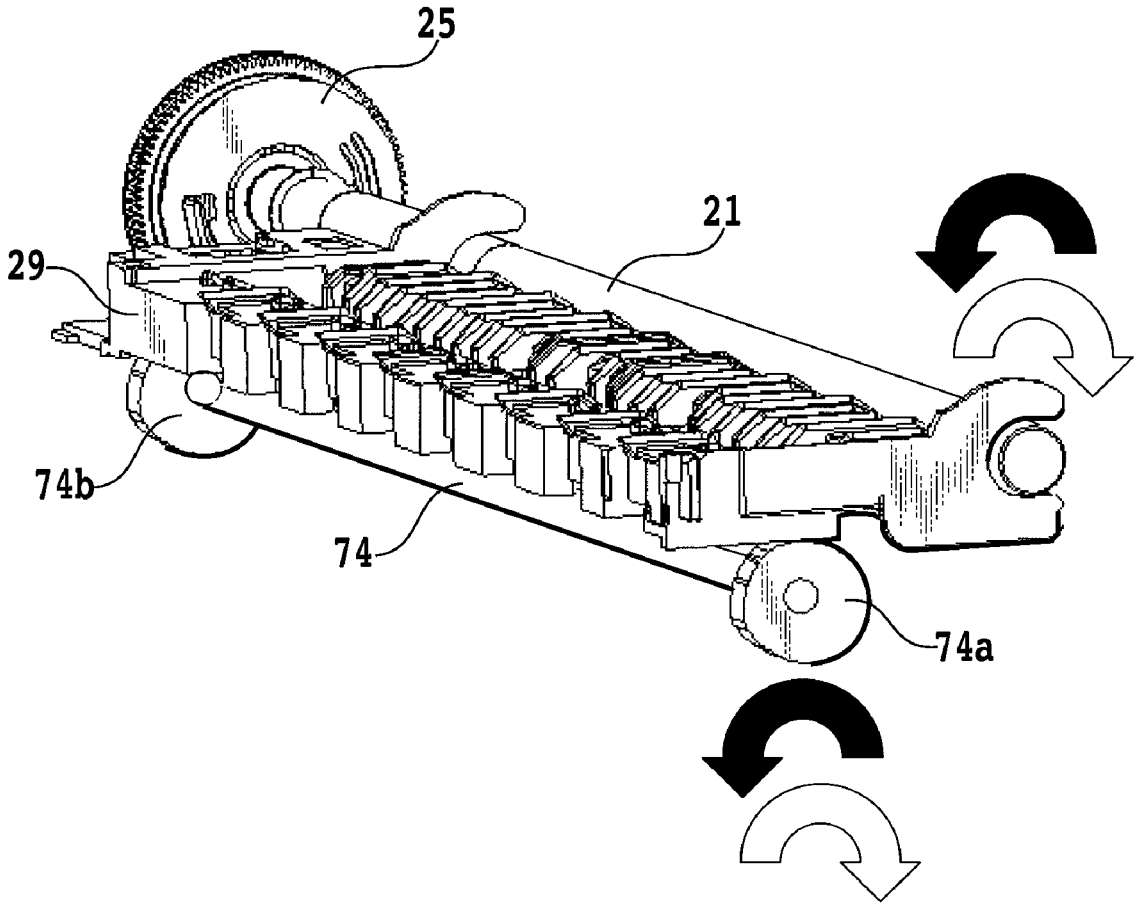
FIG. 14 is a diagram illustrating other configuration of a head-to-medium distance adjustment mechanism.

FIG. 14 is a view illustrating other embodiment of a head-to-medium distance adjustment mechanism, and shows a platen 29 mounted on the paper feeding roller 21 to be able to turn.

The platen 29 is mounted to be able to turn with respect to the paper feeding roller 21 with rotation center of the paper feeding roller 21 as an axis. In addition, the platen 29 is provided with a surface with which platen cams 74*a*, 74*b* provided on a platen shaft 74 contact. When the platen shaft 74 turns, the platen cams 74*a*, 74*b* turn, and a cam surface of the platen cams 74*a*, 74*b* contacting with the platen changes. The platen cams 74*a*, 74*b* have shapes in which the distance to the platen contacting position from the rotation center of the platen shaft 74 changes gradually. Herewith, when turning the platen shaft 74, the platen 29 turns with the axis of the paper feeding roller 21 as the center. A turning amount of the platen 29 is controlled by a rotational position of the platen shaft 74, and thereby it is possible to adjust a difference of the head-to-medium distances at the upstream side ejection port and the downstream side ejection port in the conveying direction. Meanwhile, rotational driving of the platen shaft 74 becomes possible by transmitting driving force of a motor for driving rotation of the paper feeding roller 21 by using a transmission mechanism including a clutch.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Laid-Open No. 2007-219943, filed Aug. 27, 2007, which is hereby incorporated by reference herein in its entirety.

What is claimed is:

1. An ink jet printing apparatus that uses a print head on which a plurality of ejection ports are arranged to cause the print head to scan a printing medium while ejecting ink to the printing medium during the scan of the print head, to perform printing, said apparatus comprising:

a pattern printing unit for performing printing of respective predetermined patterns by an upstream side ejection port and a downstream side ejection port, which are different in positions in a conveying direction of the printing medium, among the plurality of ejection ports;

a detecting unit for detecting densities of the respective predetermined patterns of the upstream side ejection port and the downstream side ejection port, which are printed by said pattern printing unit, and detecting a difference between a distance between the upstream side ejection port and the printing medium and a distance between the downstream side ejection port and the printing medium, based on the detected respective densities; and an adjusting unit for performing an operation for changing the distances between the respective upstream and downstream side ejection ports and the printing medium, based on the difference of the distances detected by said detecting unit.

2. The ink jet printing apparatus as claimed in claim 1, wherein said adjusting unit changes the distances so that the densities of the respective predetermined patterns printed by the upstream side ejection port and the downstream side ejection port, which are detected by said detecting unit, are equal.

3. The ink jet printing apparatus as claimed in claim 2, wherein said adjusting unit changes the distances so that the distances are equal to each other.

4. The ink jet printing apparatus as claimed in claim 1, wherein said pattern printing unit prints the respective patterns by causing reciprocatory scans of the print head.

5. The ink jet printing apparatus as claimed in claim 1, wherein said pattern printing unit prints the respective patterns by causing a plurality of scans of the print head which differ in scanning speed of the print head.

6. The ink jet printing apparatus as claimed in claim 1, wherein said adjusting unit changes the distances by causing a carriage, which mounts and moves the print head for the scan, to turn.

7. The ink jet printing apparatus as claimed in claim 1, wherein said adjusting unit changes the distances by causing a platen, which supports the printing medium, to turn.

* * * * *